US006956536B2

(12) United States Patent
Lee

(10) Patent No.: US 6,956,536 B2
(45) Date of Patent: Oct. 18, 2005

(54) DIPOLE ANTENNA

(75) Inventor: Chang-Jung Lee, Taoyuan (TW)

(73) Assignee: Accton Technology Corporation, Hsinchu (TW)

( * ) Notice: Subject to any disclaimer, the term of this patent is extended or adjusted under 35 U.S.C. 154(b) by 32 days.

(21) Appl. No.: 10/719,090

(22) Filed: Nov. 20, 2003

(65) Prior Publication Data

US 2005/0110697 A1 May 26, 2005

(51) Int. Cl.[7] ..... H01Q 1/38; H01Q 9/16

(52) U.S. Cl. ..... 343/793; 343/700 MS; 343/795

(58) Field of Search ..... 343/793, 795, 343/700 MS, 893, 904, 794, 800; H01Q 9/16, H01Q 1/38

(56) References Cited

U.S. PATENT DOCUMENTS

| | | | | |
|---|---|---|---|---|
| 5,319,377 A * | 6/1994 | Thomas et al. | ..... | 343/700 MS |
| 6,018,324 A * | 1/2000 | Kitchener | ..... | 343/795 |
| 6,424,311 B1 * | 7/2002 | Tsai et al. | ..... | 343/795 |
| 6,753,814 B2 * | 6/2004 | Killen et al. | ..... | 343/700 MS |

* cited by examiner

*Primary Examiner*—Trinh Vo Dinh
(74) *Attorney, Agent, or Firm*—Pro-Techtor Int'l Services

(57) ABSTRACT

A dipole antenna is disclosed, and two electrodes thereof are respectively disposed on two surfaces of a substrate, wherein those two surfaces are parallel to each other. Metallic layers allocated in the substrate are used to control impedance match, and to promote the antenna gain and operation bandwidth of the dipole antenna.

18 Claims, 9 Drawing Sheets

DIPOLE ANTENNA

FIELD OF THE INVENTION

The present invention relates to a dipole antenna, and more particularly, to the dipole antenna having two electrodes disposed respectively on two essentially parallel surfaces of a substrate.

BACKGROUND OF THE INVENTION

An antenna in the communication products is an element mainly used for radiating or receiving signals, and generally, the features of antenna are determined by the parameters of operation frequency, radiation patterns, reflected loss, and antenna gain, etc. According to different operation requirements, the functions equipped in the communication products are not all the same, and thus there are many varieties of antenna designs used for radiating or receiving signals, such as a dipole antenna, a rhombic antenna, a turnstile antenna, a triangular microstrip antenna, and an inverted-F antenna, etc.

A conventional dipole antenna applied in a wireless transmission device generally is a straight-line-typed dipole antenna. Referring to FIG. 1, FIG. 1 is a schematic diagram showing a conventional dipole antenna. Such as shown in FIG. 1, the conventional dipole antenna is composed of two symmetrical electrodes 20 opposite to each other, wherein those two electrodes 20 are located on the same plane of a substrate 10, and are electrically connected to feeding points 30. The aforementioned dipole antenna is commonly designed to obtain the antenna features of low Q value, high gain and broad bandwidth, and the method applied therein is generally directed to making the cross-sections of the twin electrodes 20 as large as possible for the dipole antenna. The dipole antenna having larger cross-sections can be made resonate at a lower frequency, and the length thereof can be shortened. Currently, a central-feeding-typed dipole antenna is a better choice, of which the impedance can be changed by adjusting the location of the feeding points 30, thereby making the impedance of the dipole antenna perfectly matching the impedances of transmission lines.

However, for the aforementioned conventional dipole antenna, the antenna performance can be promoted merely by focusing on the design of the length or thickness of the antenna electrodes, and the aforementioned technology still has quite a bottleneck for performance improvement. Further, with more enhanced circuit integration, the antenna design is also expected to be combined with the back-end circuit design, so as to make full use of an electric circuit board. However, conventionally, when an antenna is directly installed on an electric circuit board, the area surrounding the antenna on the electric circuit board usually has to be designed different from the other areas thereon, such as implementing different metallic layers on the area surrounding the antenna. Therefore, the conventional technology has quite a few design limitations and high difficulty level of process.

Hence, there is an urgent need to develop a dipole antenna which can be briefly merged into an integral circuit design, and has excellent antenna features of high gain and broad bandwidth, etc.

SUMMARY OF THE INVENTION

An object of the present invention is to provide a dipole antenna, wherein the dipole antenna can be briefly merged into an entire electric circuit layout.

Another object of the present invention is to provide a dipole antenna for achieving the purpose of impedance matching by adjusting the number or positions of the metallic layers located in a substrate.

Still another object of the present invention is to provide a dipole antenna for obtaining high antenna gain and broad bandwidth.

According to the aforementioned objects, the present invention provides a dipole antenna, in which a first radiator and a second radiator are respectively formed on a first surface and a second surface of a substrate, wherein the first surface and the second surface are essentially parallel to each other, and the area covered by the first radiator is not overlapped with the area of the first surface onto which the second radiator is projected. A first feeding point is installed on one end of the first radiator near the second radiator, and a second feeding point is installed on the area of the first surface on which one end of the second radiator near the first radiator is projected, wherein the second feeding point is electrically connected to the second radiator. Further, first metallic layers and second metallic layers which are separated from each other can be further formed in the substrate, wherein the first metallic layers are corresponding to the first radiator in layout, and the second metallic layers are corresponding to the second radiator in layout, and the first metallic layers may not be connected directly to the first radiator, and the second radiator can be directly connected to the second radiator.

Hence, with the use of the present invention, the dipole antenna can be briefly merged into the entire electric circuit layout, and the purpose of impedance matching can be achieved, and the excellent antenna features of high antenna gain and broad bandwidth can be obtained as well.

BRIEF DESCRIPTION OF THE DRAWINGS

The foregoing aspects and many of the attendant advantages of this invention will become more readily appreciated as the same becomes better understood by reference to the following detailed description, when taken in conjunction with the accompanying drawings, wherein.

DETAILED DESCRIPTION OF THE PREFERRED EMBODIMENT

Hereinafter, the preferred embodiments of the present invention will be described in detail with reference to the accompanying drawings.

Referring to FIG. 2 to FIG. 5, FIG. 2 to FIG. 5 illustrate a dipole antenna, according to a preferred embodiment of the present invention, wherein the fundamental radiation structure of an antenna 200 is formed mainly by disposing a first radiator 21*a* and a second radiator 21*b* respectively on a first surface 11*a* and a second surface 11*b* of a substrate 100, and the first surface 11*a* is essentially parallel to the second surface 11*b*.

The substrate 100 is made of dielectric material, such as FR4, etc. The first radiator 21*a* and the second radiator 21*b* are formed by disposing electrically-conductive material respectively on the non-overlapped areas of the first surface 11*a* and the second surface 11*b*, such as on the left half portion of the first surface 11*a* and the right half portion of the second surface 11*b*. Further, a first feeding point 22*a* is installed on one end of the first radiator 21*a* near the second radiator 21*b*, and a second feeding point 22*b* is installed on an area of the first surface 11*a* which is not disposed with the first radiator 21*a* and is adjacent to the first feeding point 22*a*. The second feeding point 22*b* is made of electrically-conductive material, and is electrically connected to the second radiator 21*b*.

The aforementioned second radiator 21*b* can be electrically connected to the second feeding point 22*b* by means of a via 22*c* penetrating through the substrate 100. However, the method for electrically connecting the second radiator 21*b* to the second feeding point 22*b* is not limited thereto, and other electrical connection methods can also be used.

On the other hand, the first radiator 21*a* and the second radiator 22*b* are essentially identical in geometrical shape and size, i.e. the first radiator 21*a* and the second radiator 21*b* are skew-symmetrical to each other in the substrate 100. Moreover, the shapes of the first radiator 21*a* and the second radiator 21*b* can be such as rectangles, circles, inverted-F shapes or any other shapes that can generate required radiation patterns.

Further, the substrate 100 can be made of a printed circuit board, and the first radiator 21*a* and the second radiator 21*b* can be formed on the printed circuit board by etching or transfer printing.

Figure 1:
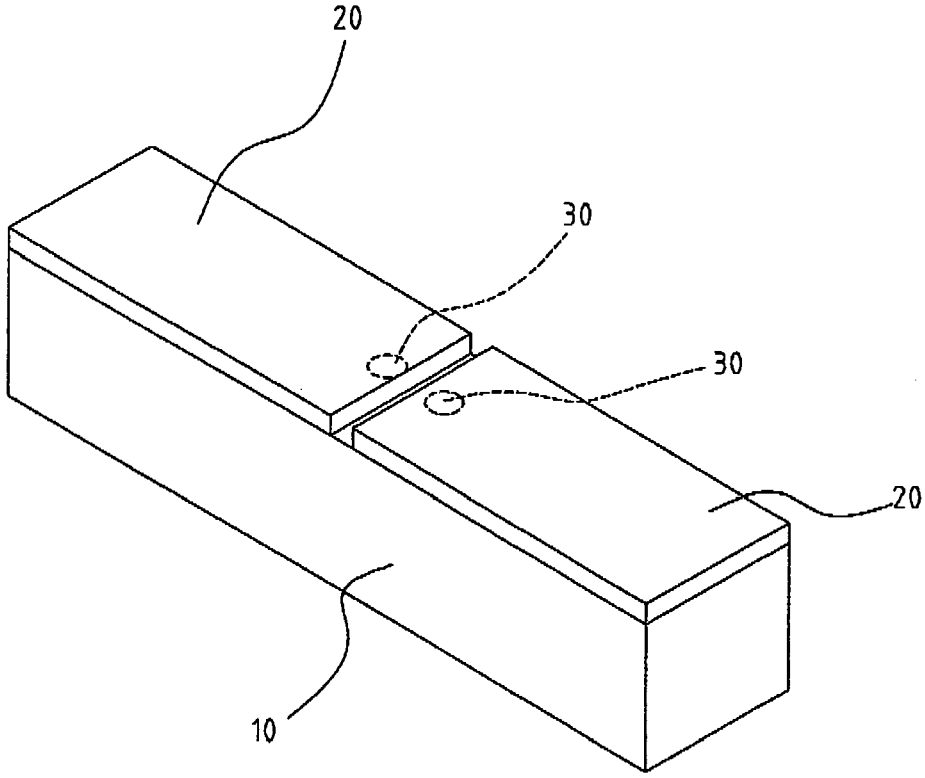
Fig. 1 (Prior Art)
FIG. 1 is a schematic diagram showing a conventional dipole antenna.
Figure 2:
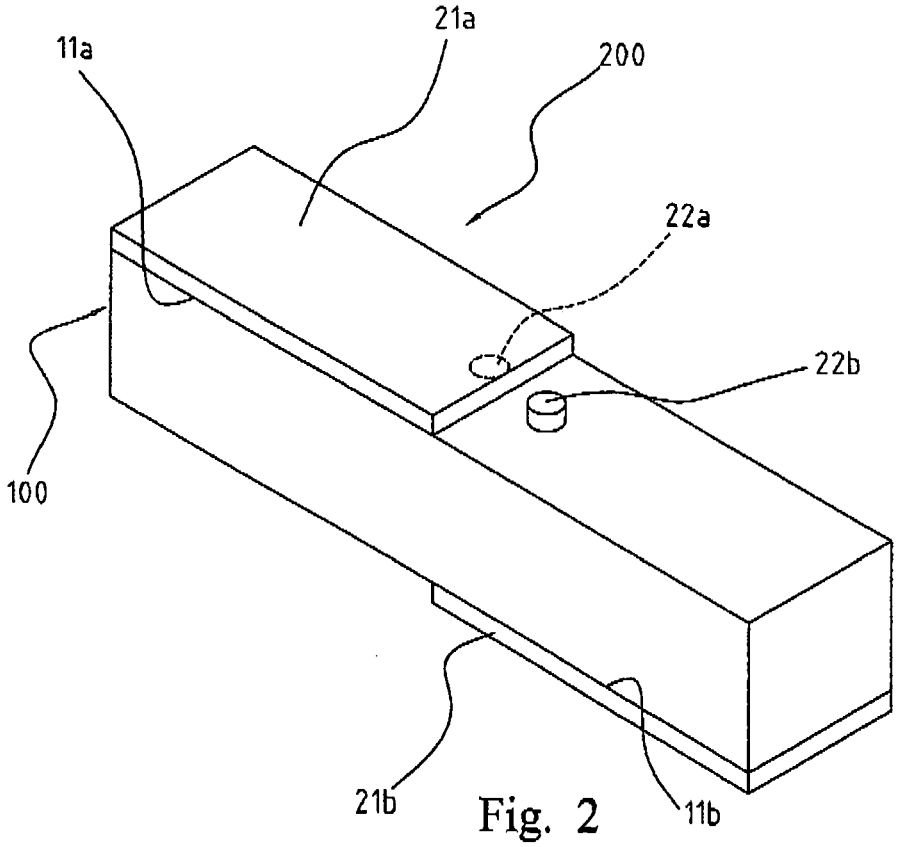
FIG. 2 is a 3-D schematic diagram showing a dipole antenna, according to a preferred embodiment of the present invention.
Figure 3:
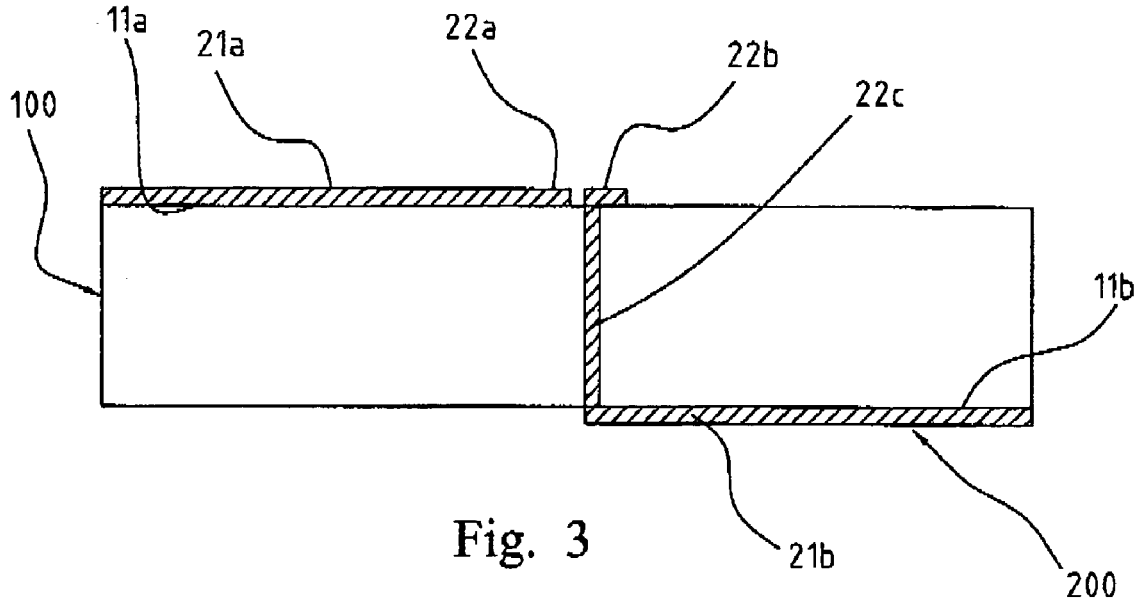
FIG. 3 is a schematic diagram showing the cross-sectional front view of the dipole antenna, according to the preferred embodiment of the present invention.
Figure 4:
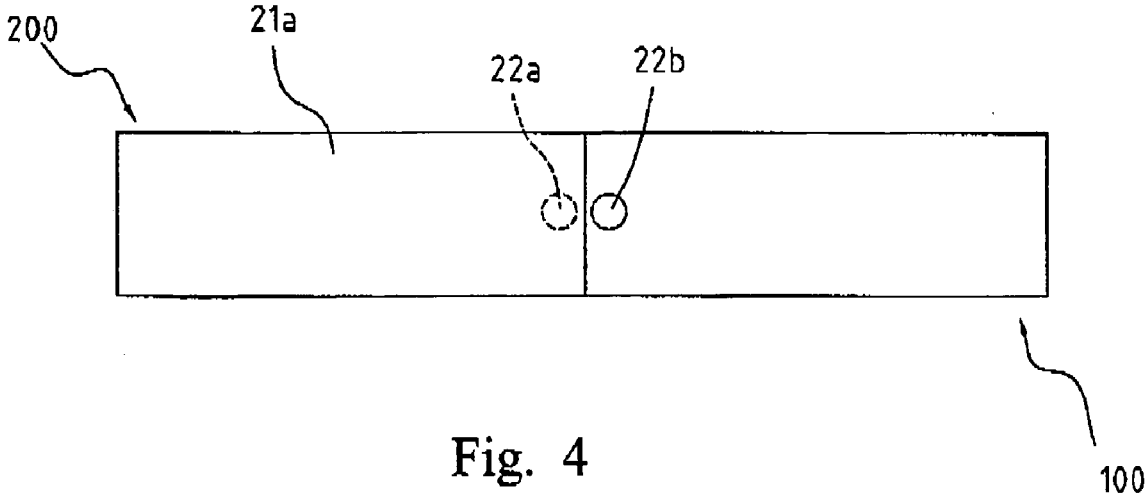
FIG. 4 is a schematic diagram showing the top view of the dipole antenna, according to the preferred embodiment of the present invention.
Figure 5:
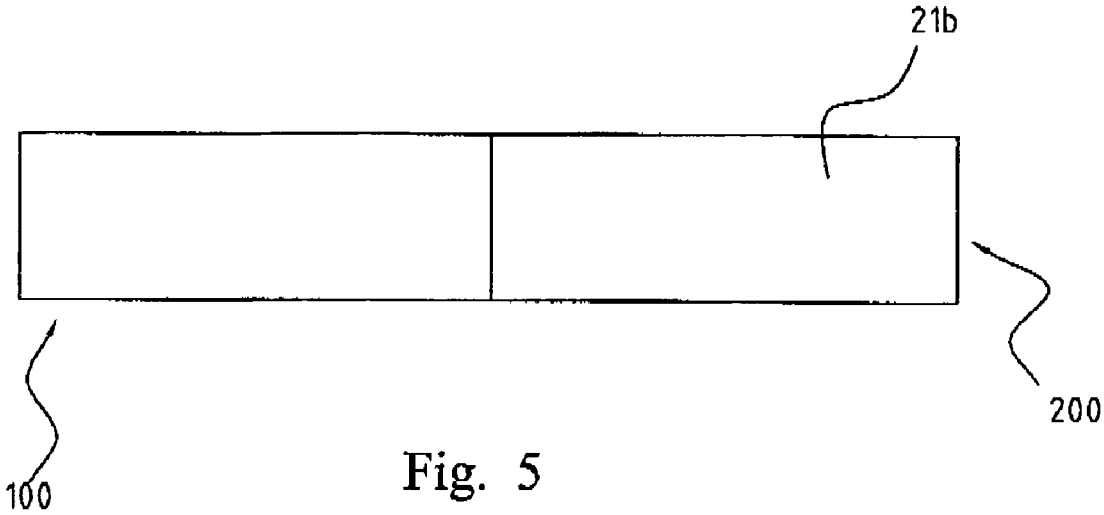
FIG. 5 is a schematic diagram showing the bottom view of the dipole antenna, according to the preferred embodiment of the present invention.
Figure 6:
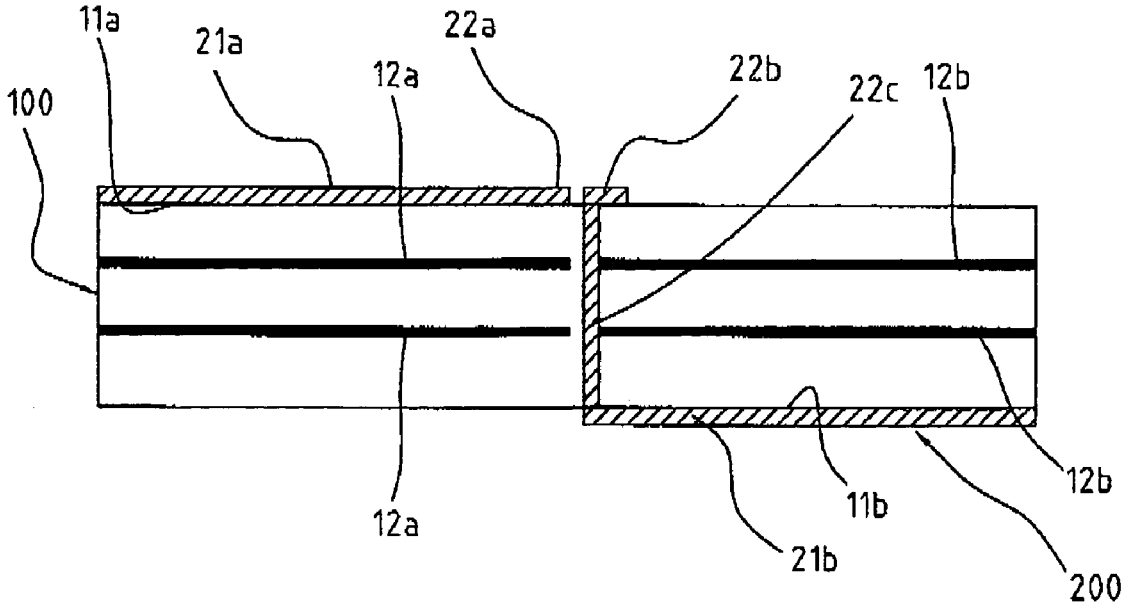
FIG. 6 is a schematic diagram showing the cross-sectional front view of a dipole antenna, according to the other preferred embodiment of the present invention.

Referring to FIG. 6, FIG. 6 is a schematic diagram showing a dipole antenna, according to the other preferred embodiment of the present invention, wherein the major radiation structure of an antenna 200 is formed mainly by disposing a first radiator 21*a* and a second radiator 21*b* respectively on a first surface 11*a* and a second surface 11*b* of a substrate 100, and the components identical to those in FIG. 2 to FIG. 5 are denoted by the same numbers and will not be explained again herein.

In comparison to the aforementioned embodiment, one or more layers of first metallic layers 12*a* and second metallic layers 12*b* respectively corresponding to the first radiator 21*a* and the second radiator 21*b* in layout are formed inside or on the surface of the substrate 100, i.e. the number of the first metallic layers 12*a* and that of the second metallic layers 12*b* can be determined independently in accordance with actual needs. Preferably, there is no direct connection among the first metallic layers 12*a* and the second metallic layers 12*b*, and also no direct connection between the first metallic layers 12*a* and the first radiator 21*a*. However, the second metallic layers 12*b* and the second radiator 21*b* are electrically connected to a second feeding point 22*b*.

The aforementioned second radiator 21*b* can be electrically connected to the second metallic layers 12*b* and the second feeding point 22*b* at the same time by means of a via 22*c* penetrating through the substrate 100. However, the method for electrically connecting the second radiator 21*b* to the second metallic layers 12*b* and the second feeding point 22*b* is not limited thereto, and other electrical connection methods can also be used.

Further, the antenna impedance matching can be achieved by adjusting the number, thickness, material of the first metallic layers 12*a* or the spacings between the first metallic layers 12*a*, and the second metallic layers 12*b* are coupled with the second radiator 21*b* as a portion of the antenna radiators. When the substrate 100 is a multi-layered electric circuit board, the number and the structure of the metallic layers existing in the multi-layered electric circuit board can be directly used as the structure as shown by the first metallic layers 12*a* and the second metallic layers 12*b*, whereby the antenna 200 can be briefly integrated into the design of the existing electric circuit board and the layout of the metallic layers adjacent to the antenna in the multi-layered electric circuit board does not need to be modified.

Figure 7A:
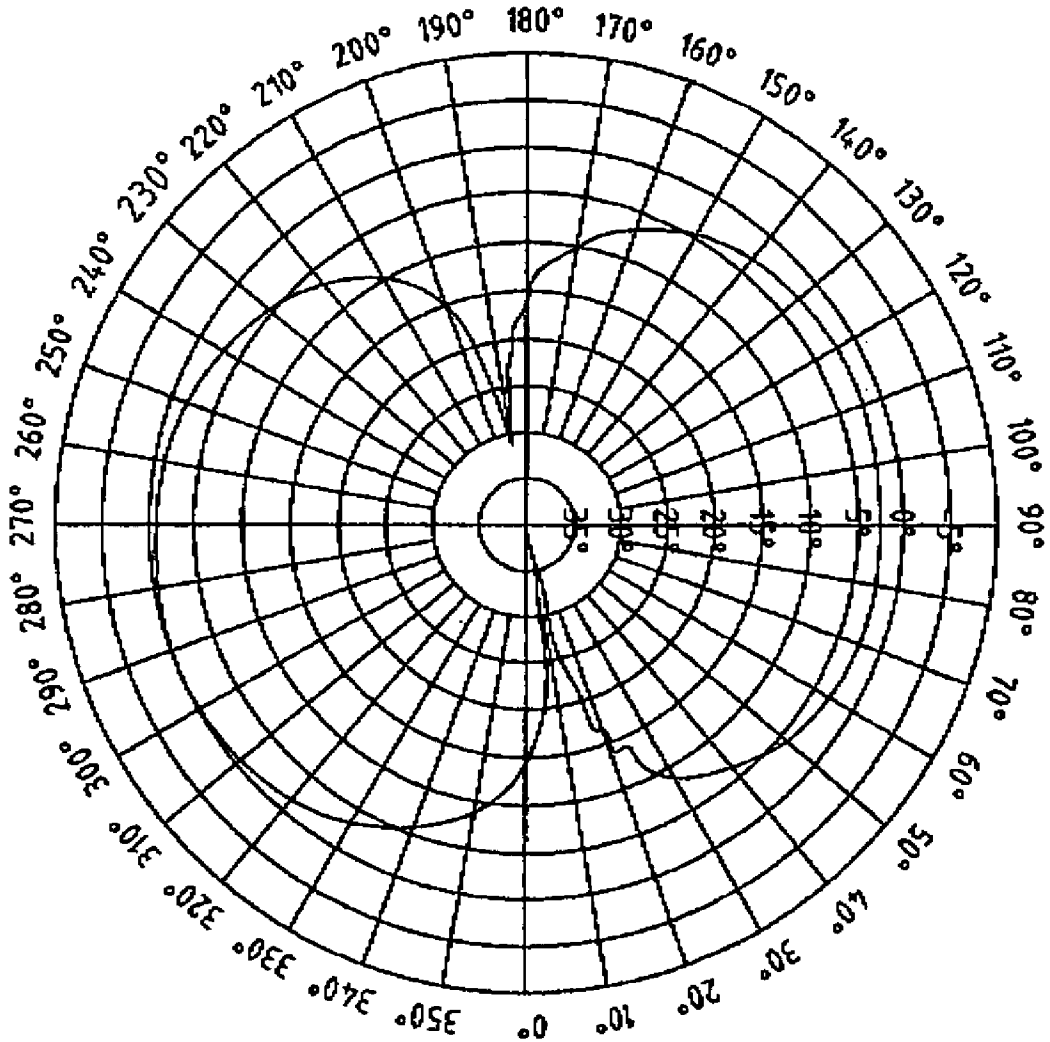
FIG. 7*a* and FIG. 7*b* are diagrams respectively showing radiation patterns in E-plane and H-pane when the dipole antenna of the present invention is operated at 2.4 GHz.
Figure 7B:
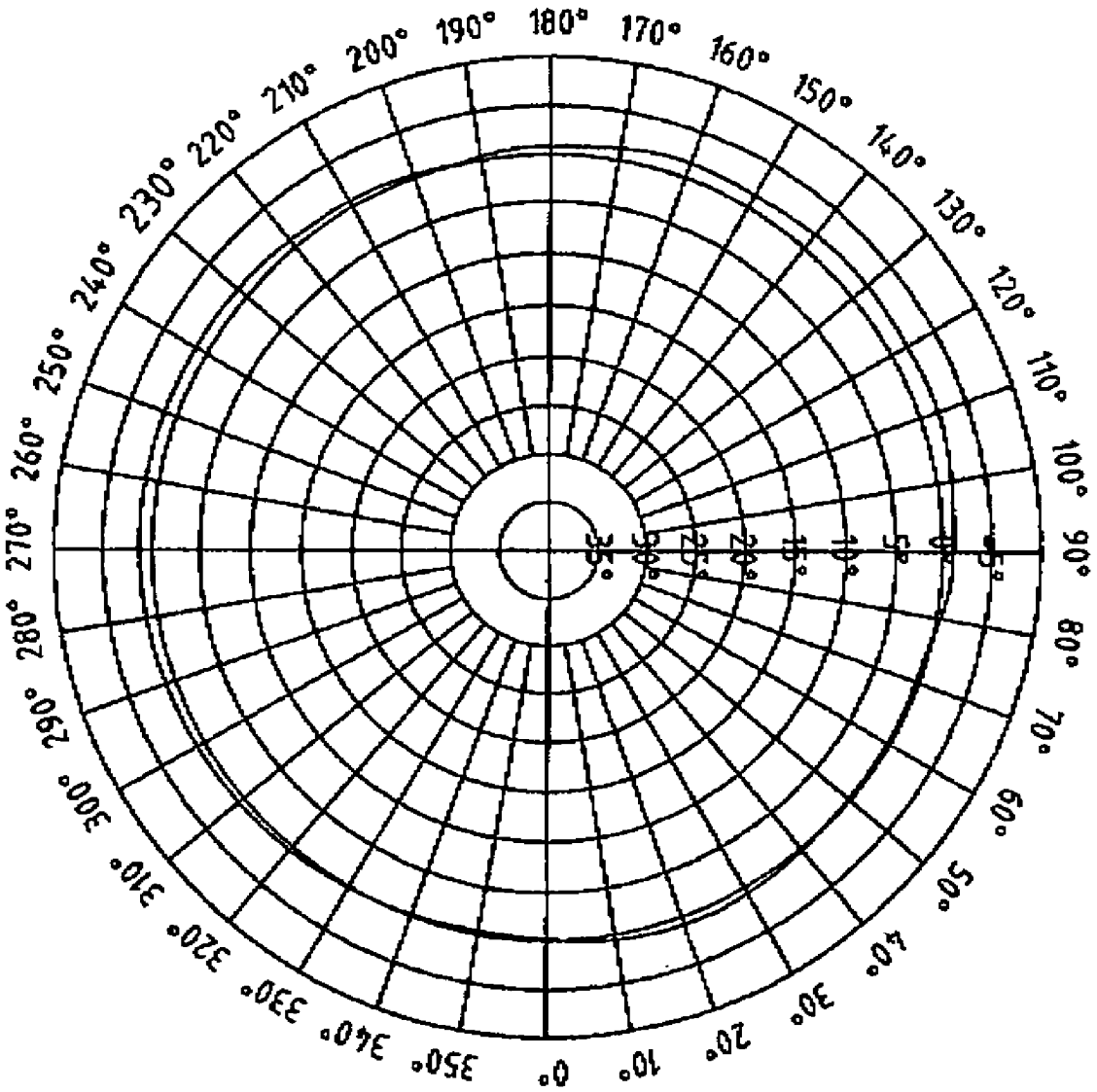

Referring FIG. 7*a* and FIG. 7*b*, FIG. 7*a* and FIG. 7*b* are diagrams respectively showing radiation patterns in E-plane and H-pane when the dipole antenna 200 of the present invention is operated at 2.4 GHz. According to the radiation pattern in E-plane, the maximum antenna gain is 0.42 dbi, and the minimum antenna gain is −46.50 dbi, wherein the average antenna gain is −3.88 dbi. According to the radiation pattern in H-plane, the maximum antenna gain is 1.79 dbi, and the minimum antenna gain is −0.59 dbi, wherein the average antenna gain is 0.63 dbi.

Figure 8A:
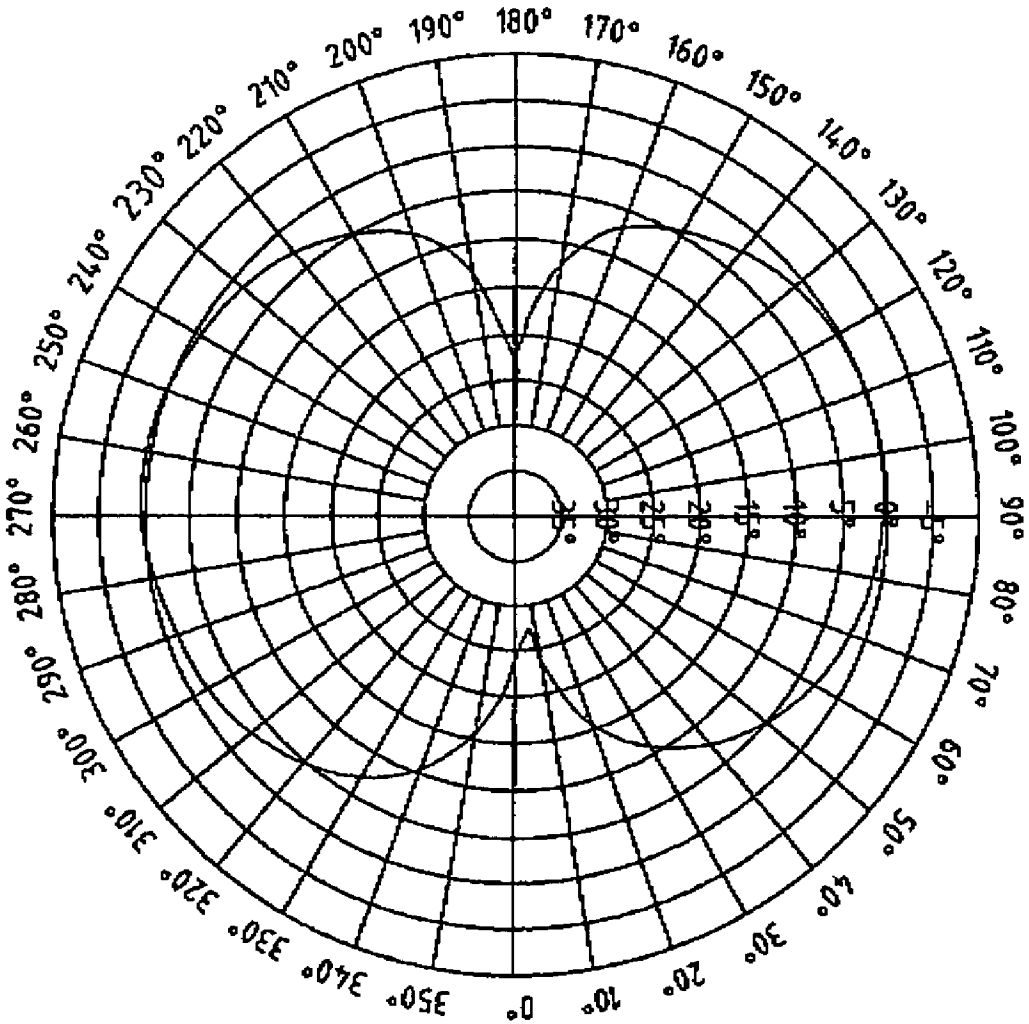
FIG. 8*a* and FIG. 8*b* are diagrams respectively showing radiation patterns in E-plane and H-pane when the dipole antenna of the present invention is operated at 2.45 GHz.
Figure 8B:
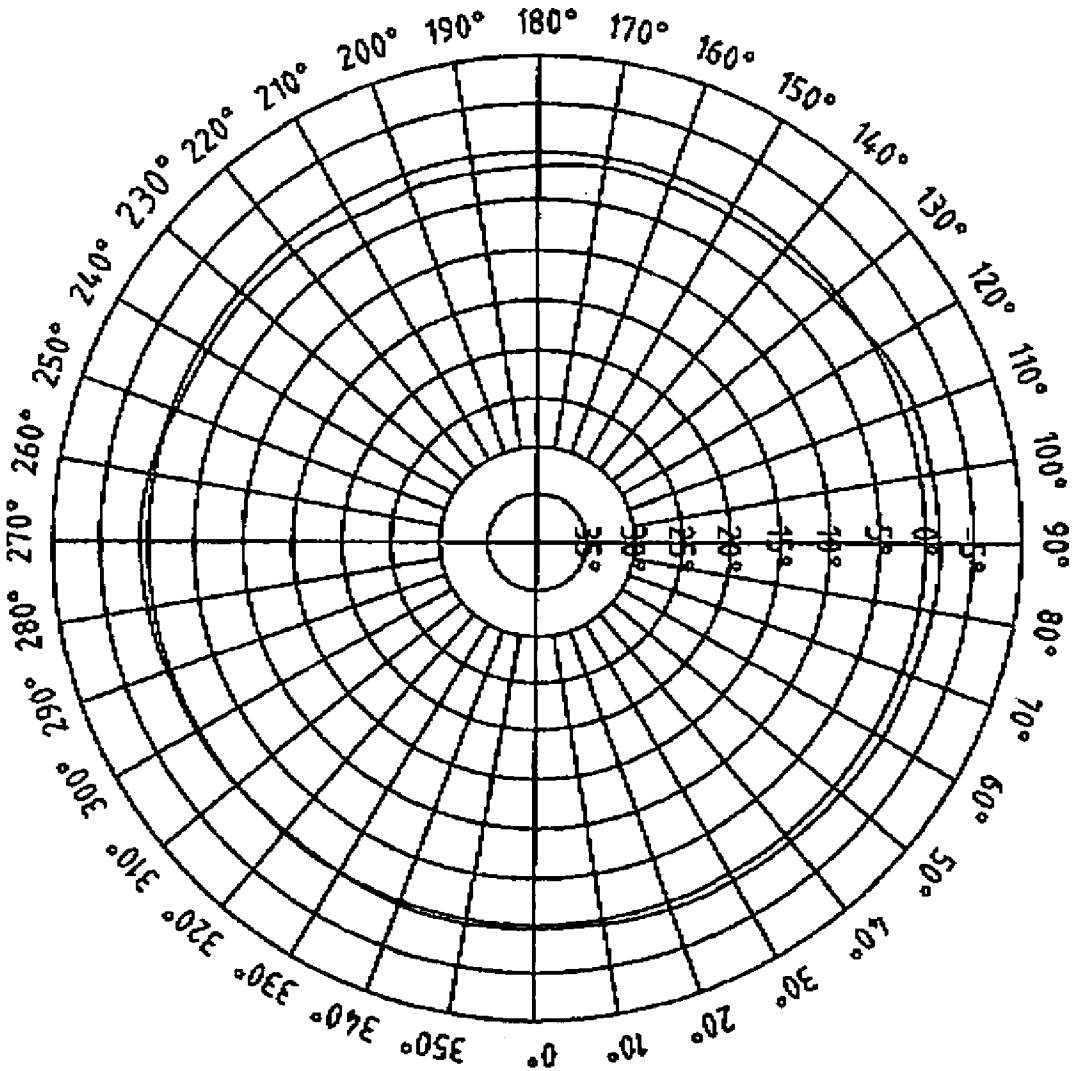

Referring FIG. 8*a* and FIG. 8*b*, FIG. 8*a* and FIG. 8*b* are diagrams respectively showing radiation patterns in E-plane and H-pane when the dipole antenna 200 of the present invention is operated at 2.45 GHz. According to the radiation pattern in E-plane, the maximum antenna gain is 0.12 dbi, and the minimum antenna gain is −27.67 dbi, wherein the average antenna gain is −3.22 dbi. According to the radiation pattern in H-plane, the maximum antenna gain is 1.39 dbi, and the minimum antenna gain is −1.60 dbi, wherein the average antenna gain is −0.04 dbi.

Figure 9A:
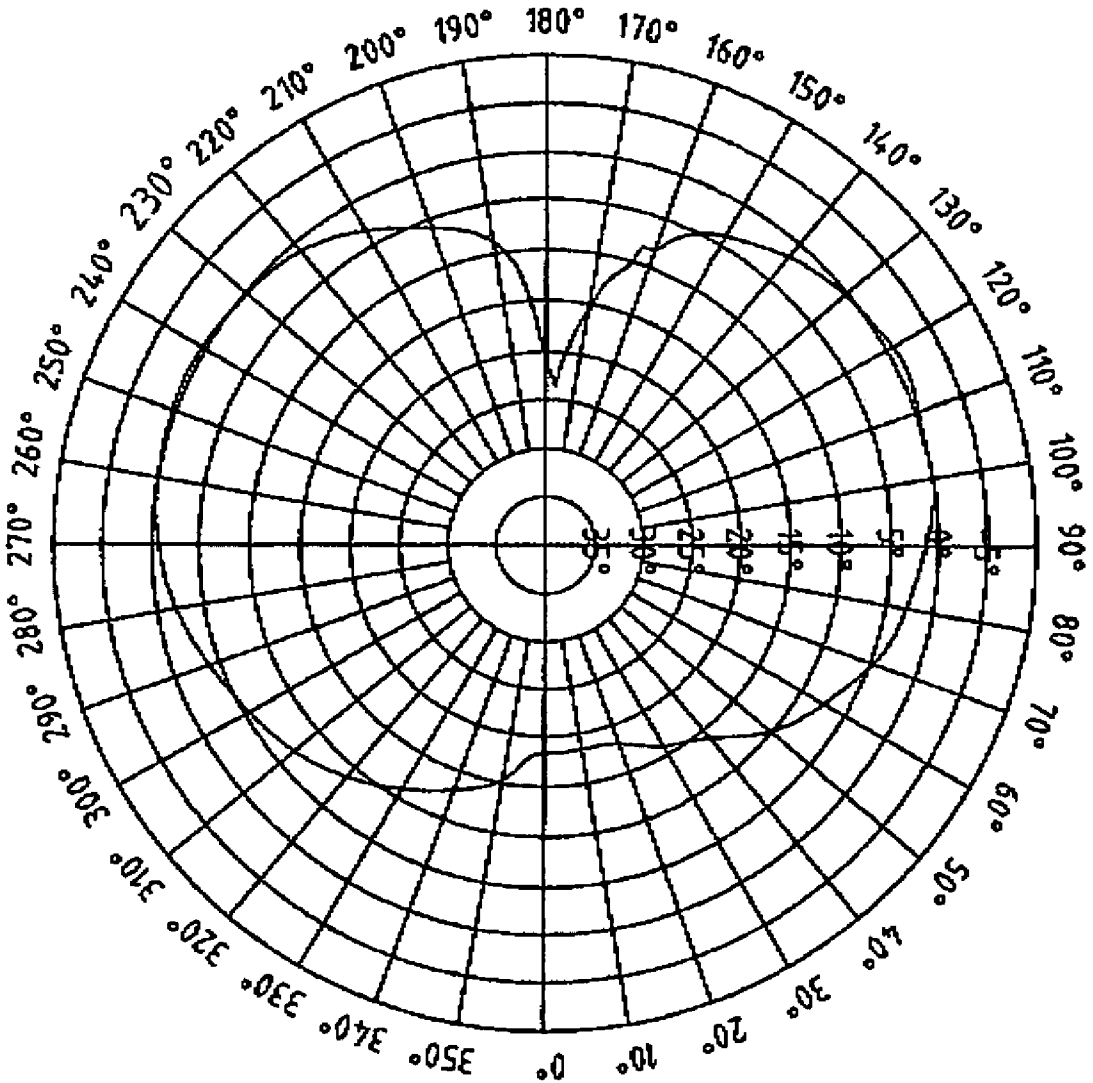
FIG. 9*a* and FIG. 9*b* are diagrams respectively showing radiation patterns in E-plane and H-pane when the dipole antenna of the present invention is operated at 2.5 GHz.
Figure 9B:
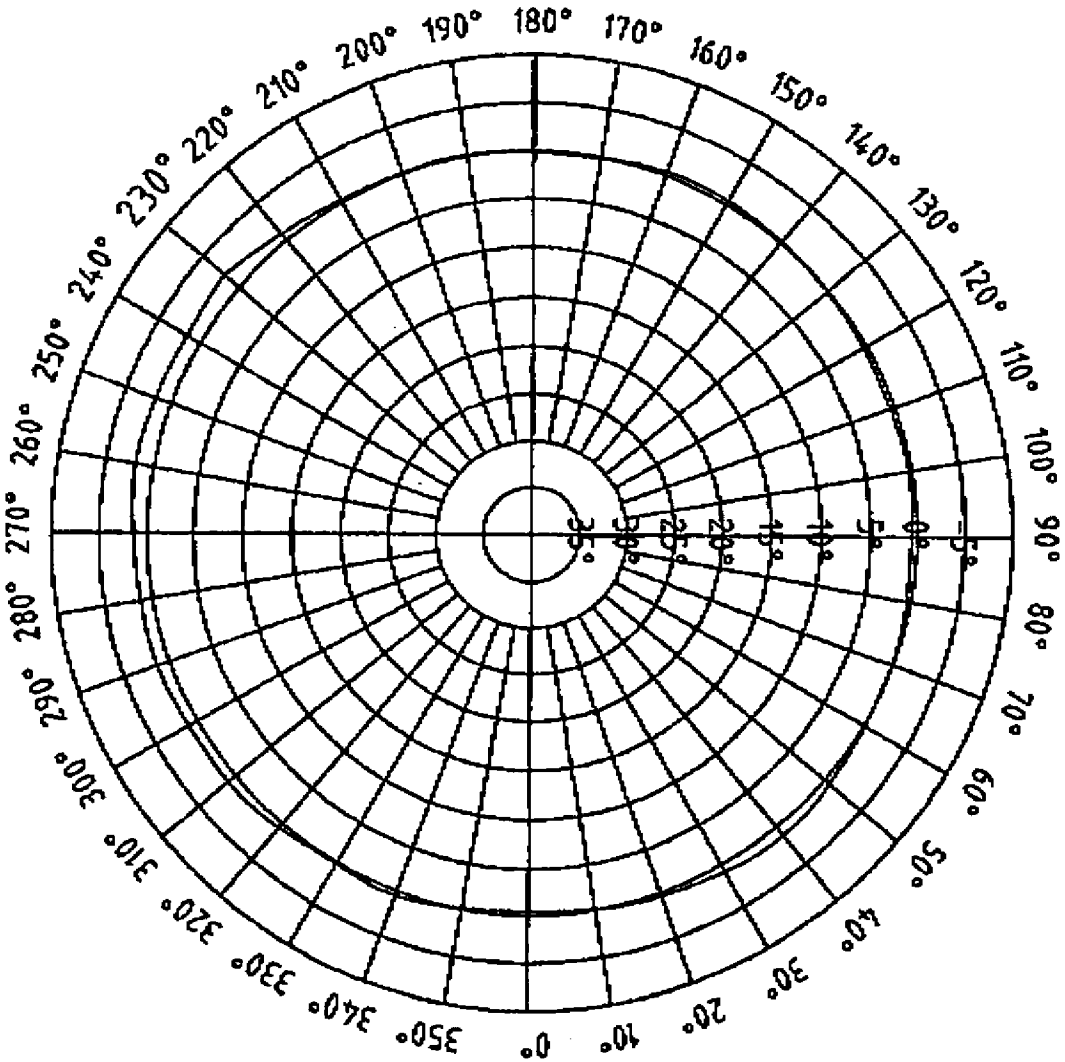

Referring FIG. 9*a* and FIG. 9*b*, FIG. 9*a* and FIG. 9*b* are diagrams respectively showing radiation patterns in E-plane and H-pane when the dipole antenna 200 of the present invention is operated at 2.5 GHz. According to the radiation pattern in E-plane, the maximum antenna gain is 0.42 dbi, and the minimum antenna gain is −23.36 dbi, wherein the average antenna gain is −3.67 dbi. According to the radiation pattern in H-plane, the maximum antenna gain is 1.59 dbi, and the minimum antenna gain is −0.70 dbi, wherein the average antenna gain is 0.28 dbi. Hence, it can be from FIG. 7 to FIG. 9 that, while being operated at the frequency from 2.4~2.5 GHz, the dipole antenna of the present invention can obtain high antenna gain and meanwhile maintain the feature of omni-directional antenna.

As is understood by a person skilled in the art, the foregoing preferred embodiments of the present invention are illustrated of the present invention rather than limiting of the present invention. It is intended to cover various modifications and similar arrangements included within the spirit and scope of the appended claims, the scope of which should be accorded the broadest interpretation so as to encompass all such modifications and similar structures.

What is claimed is:

1. A dipole antenna, comprising:

a substrate, made of a dielectric material, wherein said substrate has a first surface and a second surface which is essentially parallel to said first surface;

a first radiator, formed on said first surface;

a second radiator, formed on a portion of said second surface, wherein said portion of said second surface is not overlapped with an area of said second surface on which said first radiator is projected;

a first feeding point, installed on one end of said first radiator near said second radiator; and a second feeding point, installed on the area of said first surface adjacent to said first feeding point, wherein said second feeding point is electrically connected to said second radiator, wherein said substrate comprises at least one first metallic layer aligned with said first radiator; and at least one second metallic layer aligned with said second radiator, and said second metallic layer is electrically connected to said second radiator.

2. The dipole antenna of claim 1, wherein said substrate is a printed circuit board.

3. The dipole antenna of claim 2, wherein said first radiator and said second radiator are printed on said printed circuit board.

4. The dipole antenna of claim 1, wherein said first radiator is essentially identical to said second radiator in geometrical shape.

5. The dipole antenna of claim 1, wherein said first radiator and said second radiator are essentially rectangular.

6. The dipole antenna of claim 1, wherein said first radiator and said second radiator are skew-symmetrical to each other on said substrate.

7. The dipole antenna of claim 7, wherein said substrate is a multi-layered structure containing said first metallic layer and said second metallic layer.

8. The dipole antenna of claim 1, wherein said second feeding point, said second metallic layer and said second radiator are electrically connected by means of a via.

9. The dipole antenna of claim 1, wherein said substrate is a multi-layered printed circuit board.

10. A dipole antenna, comprising:

a substrate, made of a dielectric material, wherein said substrate has a first surface and a second surface which is essentially parallel to said first surface, said substrate comprising:

at least one first metallic layer, which is aligned with a first radiator; and at least one second metallic layer, which aligned with a second radiator, and said second metallic layer is electrically connected to said second radiator;

said first radiator is formed on said first surface;

said second radiator is formed on a portion of said second surface, wherein said portion of said second surface is not overlapped with an area of said second surface on which said first radiator is projected;

a first feeding point, installed on one end of said first radiator near said second radiator; and a second feeding point, installed on an area of said first surface adjacent to said first feeding point, wherein said second feeding point is electrically connected to said second radiator.

11. The dipole antenna of claim 10, wherein said substrate is a printed circuit board.

12. The dipole antenna of claim 11, wherein said first radiator and said second radiator are printed on said printed circuit board.

13. The dipole antenna of claim 10, wherein said first radiator is essentially identical to said second radiator in geometrical shape.

14. The dipole antenna of claim 10, wherein said first radiator and said second radiator are essentially rectangles.

15. The dipole antenna of claim 10, wherein said first radiator and said second radiator are skew-symmetrical to each other in said substrate.

16. The dipole antenna of claim 10, wherein said substrate is a multi-layered structure containing said first metallic layer and said second metallic layer.

17. The dipole antenna of claim 10, wherein said second feeding point, said second metallic layer and said second radiator are electrically connected by means of a via.

18. The dipole antenna of claim 10, wherein said substrate is a multi-layered printed circuit board.

* * * * *